US005114156A

United States Patent [19]

Saunders

[11] Patent Number: 5,114,156

[45] Date of Patent: May 19, 1992

[54] ARROW POINT

[75] Inventor: Charles A. Saunders, Columbus, Nebr.

[73] Assignee: Saunders Archery Company, Columbus, Nebr.

[21] Appl. No.: 704,107

[22] Filed: May 22, 1991

[51] Int. Cl.[5] ..... F42B 6/08

[52] U.S. Cl. ..... 273/419; D22/115

[58] .Field of Search ..... 273/419, 420; D22/115

[56] References Cited

U.S. PATENT DOCUMENTS

| | | | |
|---|---|---|---|
| D. 244,448 | 5/1977 | Bonine et al. | D22/115 |
| 2,289,284 | 7/1942 | Chandler | 273/419 X |
| 3,868,114 | 2/1975 | Groner | 273/419 |
| 4,050,696 | 9/1977 | Troncoso, Jr. | 273/420 |
| 4,944,520 | 7/1990 | Fingerson et al. | 273/419 |
| 4,988,112 | 1/1991 | Anderson et al. | 273/420 |

FOREIGN PATENT DOCUMENTS

| | | | |
|---|---|---|---|
| 2592709 | 7/1987 | France | 273/419 |

OTHER PUBLICATIONS

Archery, Jun, 1976, p. 42, Sweetland Products Ad.
Archery, Nov. 1977, Easton Futura Bullet Points.
Archery, Dec. 1978, p. 7, Easton Klicka-Point.

*Primary Examiner*—Paul E. Shapiro

*Attorney, Agent, or Firm*—Michael G. Berkman

[57] ABSTRACT

An arrow point for hunting practice and for archery target use. The point has a smooth, uniquely-contoured, enveloping wall and includes a probe-like head, a body section, and an intermediate coupler section. The head is formed with a relatively large, forwardly-projecting, tapering tip blending with and extending forwardly from a generally cylindrical, rearwardly-displaced end sector. The body section is also generally cylindrical but has a diameter exceeding that of the head. The intermediate coupler section, which is coaxial with the head and the body section, defines longitudinally-spaced, double-inflection zones including a first zone as a junction blended with the head, and a second zone at a junction blending at the body section. The structure described has a peripheral configuration facilitating penetrating entry of the arrow point into a mat-like target. The entry is effected with minimum disruption of and with minimal friction damage to a target mat during high-speed, forced impingement of the arrow point thereagainst, and upon penetration therewithin during target use. The unique configuration and peripheral contour of the arrow point allow the mat to open with minimum destructive effects and allow arrows to enter smoothly and thus prevent the usual mat deterioration caused by the fast arrows.

6 Claims, 1 Drawing Sheet

ARROW POINT

BACKGROUND OF THE INVENTION

The present invention relates to an arrow point for hunting practice and for archery target use. More particularly, the invention is directed to an archery point which has a smooth, uniquely-contoured, enveloping or bounding wall, the peripheral configuration of the arrow point facilitating penetrating entry of the arrow point into a mat-like target.

A vexing problem experienced in the use of arrow points on mat targets is the destructive effect and the rapid deterioration which the mats undergo during such usage. The rapid destruction of such targets is believed to be due, at least in part, to the particular physical contour of the arrow point itself. The deleterious effects are believed to be enhanced when using arrow points which have abrupt or sharp changes in their peripheral contours. It is theorized that in such situations, the point entering the mat does so so rapidly as to cause sharp and violent disruption of the mat fibers. The effect is that the fibers are broken rather than displaced or pushed out of the path of the entering arrow point.

It is, therefore, a principal aim of the present invention to provide an arrow point in which the exterior configuration or contour gives rise to smooth and unobtrusive separation of the fibers of a mat as the arrow point enters, thereby preventing the premature destruction of the mat and extending its useful life.

SUMMARY OF THE INVENTION

The arrow point of the present invention is characterized in that it is constructed to define a smooth, uniquely-contoured, enveloping wall including a probe-like head, a body section, and an intermediate coupler section. The head is formed with a relatively long, forwardly-projecting, tapering tip blending with and extending forwardly from a generally cylindrical, rearwardly displaced end sector.

In a preferred embodiment of the invention, the body section of the arrow point is also generally cylindrical, but has a diameter exceeding that of the head. The intermediate coupler section, which is coaxial with the head and the body section, defines longitudinally-spaced, double-inflection zones including a first zone as a junction blending with the head, and a second zone at a junction blending with the body section.

The structure described has a peripheral configuration facilitating penetrating entry of the arrow point into a mat-like target. In accordance with the practice of the present invention, the entry of the arrow point is effected with minimum destruction of and with minimal frictioned damage to a target mat during high-speed, forced impingement of the arrow point thereagainst, and upon penetration therewithin during target use. The unique configuration and peripheral contour of the arrow point allows the mat to "open up" or separate with minimum destructive effects and allows arrows to enter smoothly, and thus prevent the usual premature mat deterioration caused by fast arrows. Other and further objects, features and advantages of the invention will be evident from a reading of the description considered in conjunction with the drawings.

BRIEF DESCRIPTION OF THE DRAWINGS

The features of the present invention which are believed to be novel are set forth with particularly in the appended claims. The invention may best be understood from the following detailed description of currently preferred embodiments thereof, taken in conjunction with the accompanying drawings, wherein:

DETAILED DESCRIPTION OF ILLUSTRATED EMBODIMENTS

The aims and objects of the present invention are achieved, in accordance with the practice of the invention, by providing, in an arrow point, a smooth, uniquely-contoured enveloping or bounding wall. The structure illustrated, described, and claimed has a peripheral configuration facilitating penetrating entry of the arrow point into a mat-like target. Such entry is effected, in accordance with the present invention, with minimum disruption of and with minimal frictional damage to and breakage of the fibers of the target mat itself. The unique configuration of the arrow point of the invention allows the mat to open up or its fibers to move apart with minimum destructive effects and allows arrows to enter smoothly and thus avoids and prevents the usual, premature deterioration ordinarily caused by fast arrows.

Figure 1:
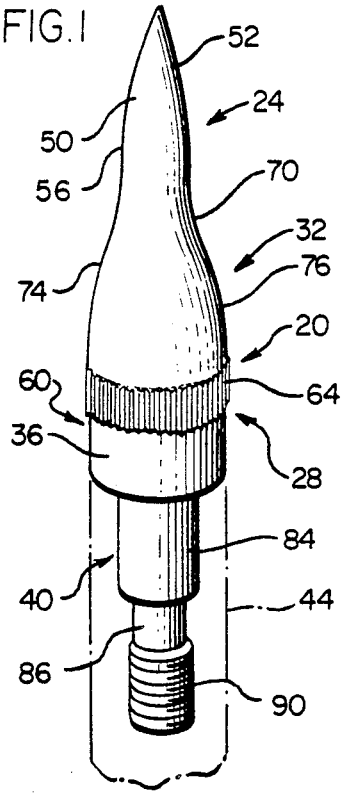
FIG. 1 is elevational view of an arrow point in accordance with the invention, embodying the features thereof.
Figure 3:
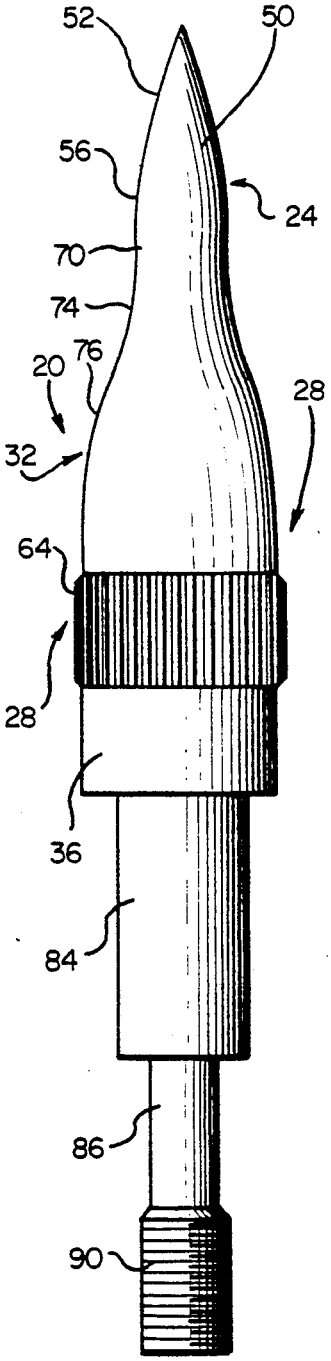
FIG. 3 is an enlarged elevational view of the arrow point of FIG. 1.
Figure 4:
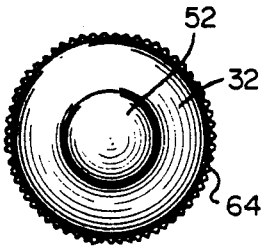
FIG. 4 is a top plan view of the arrow point of FIG. 2.
Figure 5:
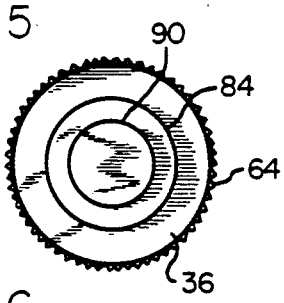
FIG. 5 is a bottom plan view thereof.
Figure 6:
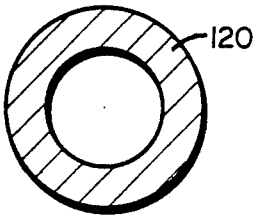
FIG. 6 is a cross sectional view taken substantially on the lines 6—6 of FIG. 2.

Referring now to the drawings, and particularly to FIGS. 1 and 3, there is shown, for illustrative purposes and not in any limiting sense, one preferred embodiment of the arrow point of the invention incorporating the features thereof.

In the specific example of the invention depicted, an arrow point 20 is shown as a unitary structure including an elongated probe section 24, a body section 28, and an intermediate or coupler section 32. Extending end-wise of the base 36 of the arrow point 20 is a stepped shank 40 by means of which the arrow point is secured in place at the tip of an arrow shaft 44.

The probe-like head 24 of the arrow point 20 is formed with a relatively long, forwardly projecting, tapering tip 50 with cross sections of smoothly varying diameters as measured along a lineal progression of the head. The angled forward section 52 of the head 24 blends into a sector 56 of substantially lessor angle or taper.

The body section 28 of the arrow point 20 has an enlarged diameter as compared with the maximum diameter of the head 24. In one embodiment of the invention the diameter of the body section 28 is substantially constant. In other of the preferred embodiments of the invention the body itself is slightly tapered outwardly from forward to rearward extremities.

As depicted schematically in the drawings, a lower sector or zone 60 of the body 28 of the arrow point 20 is knurled 64 to facilitate manipulation of the point, as may be required.

Intermediate the head 24 and the body 28 of the arrow point is a coupler section 32. The coupler is joined to the rearward end portion of the head through a first inflection zone 70 from which the coupler section flares outwardly 74 finally to blend 76 with the body 28 of the arrow point at a forward zone of this body 28. The peripheral contour of the arrow point of the invention includes lineally elongated inflection zones at each of the junctures 70 & 76 at opposed ends of the coupler section, that is, with the head 24 and with the body 28 of the point. There are no abrupt or sharp transitions from one lineal sector of the arrow point to another. All transformations in the contour of the arrow point are smooth or muted. The physical structure described is believed to contribute materially to the enhanced functional use of the arrow point of the invention in archery practice an target mat archery activities. The arrow points of the invention have been found to exhibit enhanced utility as an archery point for hunting practice and for mat target use, contributing to extended useful life for the target mats.

Referring now to the embodiment of the invention depicted in FIGS. 1 and 3, the stepped shank 40 there shown includes a first, generally cylindrical section 84 from which there extends a stud 86, of a lessor diameter, and threaded 90 at its end. The threaded end 90 is adapted threadingly to engage within an arrow shaft 44 as indicated schematically in FIG. 1.

Figure 2:
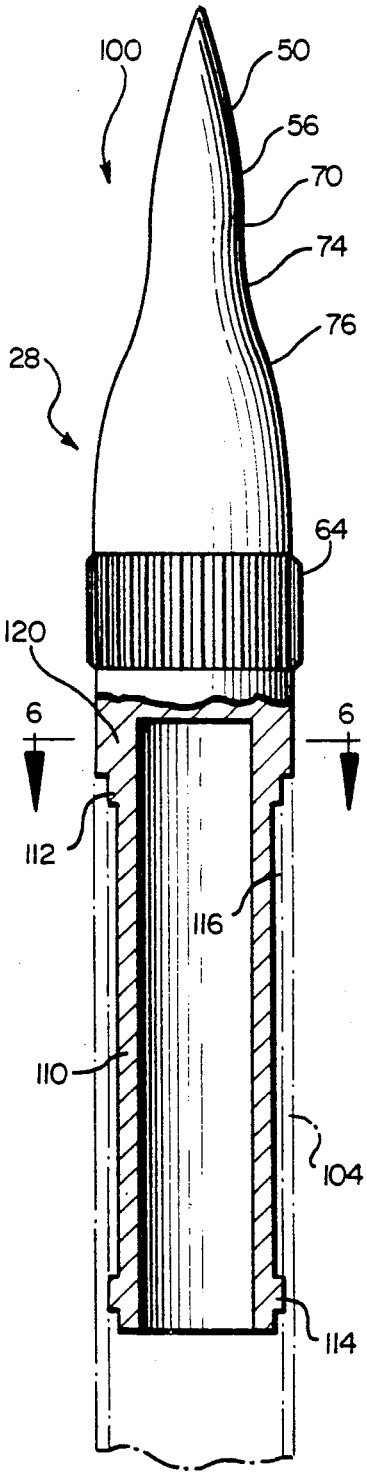
FIG. 2 is an enlarged, elevational view of a second embodiment of the arrow point of the invention adapted for use with an arrow shaft which sleeves over a hollow skirt of the arrow point.

In a second embodiment of the invention, shown in FIG. 2, the forward and principal sections of the arrow point are the same as that previously described. In the embodiment of FIG. 2, the arrow point 100 is adapted for gluing attachment to a hollow shaft arrow 104. Projecting coaxially from the base or body of the arrow point 100 is a hollow shell or casing-like extension 110. At each of opposed ends the casing 110 is formed with an encircling band or rim 112 and 114, the diameters of the bands being slightly less than an inner diameter of the hollow arrow to facilitate sliding contiguous engagement of the bands with the inner wall 116 of the hollow arrow 104. The latter is slidingly positioned to abut the arrow point body at its base 120. An adhesive-like composition or glue is used in conjunction with the structure shown to enhance the securement of the hollow arrow shaft I04 to the casing 110.

In yet another embodiment of the invention the base of the arrow point may define a hollow core into which the end of an arrow shaft may be slideably received.

While the invention has been described with reference to specific preferred embodiments, it will be appreciated that many changes, not rising to the level of invention, may be made without departing from the spirit of the invention or the scope as defined in the appended claims.

What is claimed is:

1. A long-tapered, smooth-surface contoured point for archery use, said point being round in transverse cross section, with cross sections of said point defining circles of smoothly varying diameters as measured along a lineal progression of said point, and said diameters increasing progressively in smooth increments in a non-linear mode along a longitudinal axis of said point in a direction from a leading end thereof rearwardly.

said point comprising an elongate head including a generally cylindrical rear section tapering and contoured to define at a forward zone thereof a sharp, elongate, probe-like apex, said head including a forward zone having an accurate peripheral contour progressing lengthwise of said head and exhibiting increased diameters rearwardly along a lineal expanse thereof, a body of said archery point spaced axially from and extending rearwardly of said lineal expanse of said head, said body being generally cylindrical and having an enlarged diameter as compared with diameters of said head, a coupler section of said archery point, said coupler section being positioned intermediately between and interconnecting said head with said body of said archery point, said coupler section including bounding wall means adjacent each of opposed end portions of said coupler section for defining lineally elongated inflection zones constituting spaced junctures including a first juncture of said coupler section with said head, and a second juncture of said coupler section with said body in a unitary composite structure characterized by a capacity forceably yet gently to effect physical parting of fibers in fiber mats on forced entry therewithin, and having enhanced utility as an archery point for hunting practice and for mat target use.

2. The structure as set forth in claim 1 and further comprising a stepped shank of reduced diameter as compared with said body of said point, said shank being attached to and coaxial with and extending rearwardly from said body of said arrow point, and externally threaded stub means, at a free end of said shank for penetration into and for establishing an interference bond securement within a cooperating end section of an arrow shaft.

3. The structure as set forth in claim wherein said arrow point is fabricated of rust-resistant steel.

4. The structure as set forth in claim I, wherein said point has a length dimension which is about four times that of a diameter thereof as measured at said body of said point.

5. The structure as set forth in claim and further comprising a hollow, open-ended generally cylindrical, tubular section integrally formed with and extending rearwardly of said body of said point for intersleaved attachment with a shaft of an archery arrow to be attached thereto.

6. The structure as set forth in claim 5 wherein said tubular section of said arrow point extending rearwardly of said body of said arrow point is adapted for insertion coaxially into a hollow shaft of an archery arrow for securement therewithin.

* * * * *